US012807394B2

(12) United States Patent
Leng

(10) Patent No.: US 12,807,394 B2
(45) Date of Patent: Nov. 24, 2026

(54) PACKAGING CONTAINER UNIT, PACKAGING CONTAINER, AND PACKAGING METHOD FOR STORING AND UNLOADING SPRINGS

(71) Applicant: Luhao Leng, Xiamen City (CN)

(72) Inventor: Luhao Leng, Xiamen City (CN)

( * ) Notice: Subject to any disclaimer, the term of this patent is extended or adjusted under 35 U.S.C. 154(b) by 0 days.

(21) Appl. No.: 18/829,369

(22) Filed: Sep. 10, 2024

(65) Prior Publication Data

US 2025/0100783 A1 Mar. 27, 2025

(30) Foreign Application Priority Data

Sep. 21, 2023 (CN) ..... 202311221404.9

(51) Int. Cl.
*B65D 85/04* (2006.01)
*B65B 69/00* (2006.01)
*B65D 5/02* (2006.01)

(52) U.S. Cl.
CPC ..... *B65D 85/04* (2013.01); *B65B 69/0058* (2013.01); *B65D 5/029* (2013.01)

(58) Field of Classification Search
CPC ..... B65D 85/04; B65D 5/029; B65D 21/08; B65D 25/101; B65D 85/08; B65B 25/00;
(Continued)

(56) References Cited

U.S. PATENT DOCUMENTS 1,709,034 A * 4/1929 Nelson ..... B65D 71/00 206/499
2,308,713 A * 1/1943 Price ..... B65D 85/08 24/1

(Continued)

FOREIGN PATENT DOCUMENTS

CN 201999334 U 10/2011
CN 207684180 U 8/2018

(Continued)

OTHER PUBLICATIONS

First CN Office Action cited in CN202311221404.9, mailed May 19, 2026 11 pages.

(Continued)

*Primary Examiner* — Veronica Martin
*Assistant Examiner* — Mobeen Ahmed
(74) *Attorney, Agent, or Firm* — Cooper Legal Group, LLC

(57) ABSTRACT

A packaging container unit for storing and unloading springs is provided. A box body of the packaging container unit for storing and unloading the springs is an elongated shape or a prismatic shape. The opening for unloading the spring of the packaging container unit for storing and unloading the springs is disposed on the side surface of the top end of the box body or is defined by the adjacent surfaces of the two extendable surfaces. The path for separating the springs from the packaging container unit for storing and unloading the springs through the opening for unloading the springs is perpendicular to the long axis of the packaging container unit for storing and unloading the springs. A packaging container for storing and unloading the springs and a packing method for storing and unloading the springs are further provided.

2 Claims, 8 Drawing Sheets

(58) Field of Classification Search
CPC ..... B65B 25/24; B65B 13/20; B65B 63/02; B65B 69/005; B65B 69/0058
See application file for complete search history.

(56) References Cited

U.S. PATENT DOCUMENTS

| | | | | | |
|---|---|---|---|---|---|
| 2,885,116 | A * | 5/1959 | Tregilgas | B65D 83/0409 | 221/247 |
| 2,966,280 | A * | 12/1960 | Nelson | A63B 47/00 | 221/98 |
| 3,620,412 | A * | 11/1971 | Eisner | B65D 39/02 | 221/63 |
| 3,672,493 | A * | 6/1972 | Modrey | B65D 85/08 | 132/226 |
| 3,724,716 | A * | 4/1973 | Baraconi | B65D 83/0817 | 221/61 |
| 4,042,156 | A * | 8/1977 | Knight | A63B 47/001 | 206/315.9 |
| 4,396,120 | A * | 8/1983 | Morita | B65D 85/08 | 206/820 |
| 4,610,373 | A * | 9/1986 | Sherbondy | A63B 47/002 | 221/303 |
| 4,632,299 | A | 12/1986 | Holmberg | | |
| 4,678,108 | A * | 7/1987 | Inman | A63B 47/02 | 224/919 |
| 4,869,367 | A * | 9/1989 | Kawasaki | B23K 9/1333 | 206/409 |
| 4,899,929 | A * | 2/1990 | Grollman | B65D 5/36 | 221/302 |
| 5,147,119 | A * | 9/1992 | Harris | A47B 61/003 | 312/49 |
| 5,642,811 | A * | 7/1997 | Hubner | B65D 19/44 | |
| 6,092,717 | A * | 7/2000 | Lowry | B65D 3/22 | 229/120.32 |
| 7,146,779 | B2 * | 12/2006 | Swiszcz | E04B 9/001 | 53/438 |
| 10,183,767 | B2 * | 1/2019 | Zerial | B65B 13/02 | |
| 11,199,234 | B2 * | 12/2021 | Grassold | B65D 85/08 | |
| 2002/0185400 | A1 * | 12/2002 | Meyer | B65D 85/08 | 206/445 |
| 2004/0182874 | A1 * | 9/2004 | Kringel | B65D 83/0817 | 221/34 |
| 2005/0050640 | A1 * | 3/2005 | Ahn | A47C 27/07 | 5/721 |
| 2008/0284071 | A1 * | 11/2008 | Knewtson | B65B 13/02 | 267/91 |
| 2010/0282630 | A1 * | 11/2010 | Cooper | B65D 85/04 | 206/413 |
| 2011/0099947 | A1 * | 5/2011 | Vadlja | B65B 69/00 | 53/113 |
| 2012/0297739 | A1 * | 11/2012 | Weissbrod | B65D 85/26 | 53/527 |
| 2016/0304268 | A1 * | 10/2016 | Schneider | A01K 29/00 | |
| 2016/0318680 | A1 * | 11/2016 | Zerial | B65B 13/02 | |
| 2024/0199278 | A1 * | 6/2024 | Chabert | F16F 1/128 | |
| 2024/0286234 | A1 * | 8/2024 | Chabert | B23P 19/048 | |
| 2024/0288043 | A1 * | 8/2024 | Chabert | B65D 85/08 | |

FOREIGN PATENT DOCUMENTS

| | | | | |
|---|---|---|---|---|
| CN | 109353687 | A | 2/2019 | |
| CN | 211870107 | U | 11/2020 | |
| CN | 112857594 | A | 5/2021 | |
| EP | 0559132 | A1 | 9/1993 | |
| EP | 1783058 | A1 | 5/2007 | |
| JP | 2003040362 | A | 2/2003 | |
| JP | 6305582 | B1 | 4/2018 | |
| KR | 20110007987 | U | 8/2011 | |
| KR | 20190139103 | A | 12/2019 | |
| WO | 02057147 | A1 | 7/2002 | |
| WO | WO-2016121515 | A1 * | 8/2016 | B65D 85/60 |

OTHER PUBLICATIONS

EP Office Action cited in EP24201478.5, mailed Mar. 3, 2025, 5 pages.
EP Office Action cited in EP24201478.5, mailed Nov. 7, 2025, 4 pages.
EP Search Report cited in EP24201478.5, mailed Feb. 17, 2025, 4 pages.
International Search Report cited in PCT/CN2024/120000 mailed Dec. 31, 2024, 6 pages.
Written Opinion cited in PCT/CN2024/120000 mailed Dec. 31, 2024, 7 pages.

* cited by examiner

PACKAGING CONTAINER UNIT, PACKAGING CONTAINER, AND PACKAGING METHOD FOR STORING AND UNLOADING SPRINGS

RELATED APPLICATIONS

This application claims priority to Chinese patent application number 202311221404.9, filed on Sep. 21, 2023. Chinese patent application number 202311221404.9 is incorporated herein by reference.

FIELD OF THE DISCLOSURE

The present disclosure relates the field of packaging springs, and in particular relates to a packaging container unit, a packaging container, and a packaging method for storing and reloading the springs.

BACKGROUND OF THE DISCLOSURE

Commercial boxes for packaging springs are mainly boxes having grids. For example, in CN207684180U, a space is divided into four-quadrant compartments using a support frame and partitions, each of the four-quadrant compartments is respectively loaded with a spring. A required space for packaging the springs increases due to the partitions and baffles. In CN201999334U, multiple springs are sleeved on a long paper strip end to end and then loaded into a packaging box. A wasted space caused by packaging materials is reduced by direct touch between the springs. However, this method merely folds two ends of the long paper strip reversely to prevent the springs from being separated from the long paper strip. The springs are in a natural state with relatively long lengths, and a packaging space cannot be effectively saved.

In combination with the two aforementioned methods, multiple springs can be loaded in a packaging container with an elongated shape end to end and be compressed. This method can effectively save the packaging space. However, traditional packaging barrels mainly have structures with a closed end and an open end or two open ends, and lids are required for closing the open end. If the springs are loaded in the packaging container and are compressed, the compressed springs tend to reset initial lengths and spring out of the open end of the packaging barrels. Additional pressure is needed to be applied to close the packaging barrels, and it is the same way when the lids are opened to unload the springs. The compressed springs will directly spring out of the open end, resulting in controlled unload being impossible. Therefore, traditional packaging containers having elongated shapes are not suitable for compressing, storing, and unloading of the springs.

BRIEF SUMMARY OF THE DISCLOSURE

The main technical problem that the present disclosure seeks to solve is that packaging containers having elongated shapes are not suitable for compressing, storing, and unloading of springs.

In order to address the aforementioned technical problem, the present disclosure improves a structure of a packaging container. In a first aspect, A packaging container unit for storing and unloading springs, a box body of the packaging container unit for storing and unloading the springs is an elongated shape, a bottom surface of the box body comprises a first opening, a cross-section of the box body is larger than a cross-section of each of the springs, a side surface of a top end of the box body comprises a second opening for unloading the springs, and the bottom surface of the box body is disposed with at least one of an end cover or one or more one-way toggle pieces.

According to the aforementioned technical solution, the second opening for unloading springs of the packaging container unit for storing and unloading the springs is disposed on the side surface of the top end of the box body. A direction of an elastic force of the springs is primarily upward or downward along a longitudinal axis of the box body, while a path for unloading the springs from the second opening for unloading the springs is perpendicular to the longitudinal axis of the box body. Therefore, when the second opening for unloading the springs is in an open state, the springs do not easily spring out due to the elastic force to achieve controlled unloading of the springs.

Further, the bottom surface of the box body is disposed with the one or more one-way toggle pieces extending toward an inner side of the box body to have merely forward deformation of the one or more one-way toggle pieces instead of reverse deformation. In the aforementioned technical solution, when the springs are pressed into the box body from the bottom surface, forward deformation of the one or more one-way toggle pieces results. After the springs are separated from the one or more one-way toggle pieces, the one or more one-way toggle pieces reset to initial states, preventing the springs inside the box body from being separated from the box body through the bottom surface of the box body.

Further, the one or more one-way toggle pieces form one or more acute angles with the box body, and when the springs are disposed in the box body, the one or more one-way toggle pieces swing and one or more angles of the one or more acute angles decrease.

Further, the one or more one-way toggle pieces are integrally molded with the box body. In the aforementioned technical solution, the packaging container unit for storing and unloading the springs has the advantages of a simple structure.

Further, one or more ends of the one or more one-way toggle pieces adjacent to the bottom surface of the box body extend to form one or more connecting walls, and the one or more connecting walls are connected to an outer wall of a side surface of a bottom end of the box body. In the aforementioned technical solution, a connection method between the one or more connecting walls and the outer wall of the side surface of the bottom end of the box body comprise a buckle connection, a plug-in connection, a threaded connection, a sleeved connection, or an adhesive connection, but the disclosure is not limited thereto.

Further, the one or more one-way toggle pieces comprise a plurality of one-way toggle pieces, connecting walls of the one or more connecting walls on the plurality of one-way toggle pieces are connected together to form an annular structure, and the annular structure is sleeved on the outer wall of the side surface of the bottom end of the box body and is in interference fit with the side surface of the bottom end of the box body. In the aforementioned technical solution, as the annular structure abuts the outer wall of the side surface of the bottom end of the box body, the plurality of one-way toggle pieces can be further prevented from reverse deformation and have high structural reliability. In addition, positions of the plurality of one-way toggle pieces and the annular structure are relatively fixed, and the annular structure has an interference fit with the side surface of the bottom end of the box body, which has the advantages of easy installation and simple and stable structure.

Further, an outlet cover is disposed on the box body, and when the second opening for unloading the springs is closed, the outlet cover covers the second opening for unloading the springs. In the aforementioned technical solution, the outlet cover is provided, and the springs can be prevented from being separated from the box body through the opening for unloading the springs when the springs are not required to be unloaded. The outlet cover can be integrally molded with the box body, or the outlet cover can be a cover plate disposed on the box body by a sliding rail, a cylinder sleeved on an outer wall of the side surface of the top end the box body, etc.

In a second aspect, the present disclosure provides a packaging container for storing and unloading the springs, the packaging container for storing and unloading the springs comprises at least two of the packaging container units for storing and unloading the springs. The packaging container for storing and unloading the springs has the advantages of controlled loading and unloading of the springs. In addition, when there are a large number of the springs, the springs are placed in multiple of the packaging container units for storing and unloading the springs that are respectively movable, so that a weight of each of the multiple of the packaging container units for storing and unloading the springs can be effectively reduced, which is more convenient for storage and transportation. Furthermore, the multiple of the packaging container units for storing and unloading the springs can be assembled or disassembled.

In a third aspect, the present disclosure provides a second packaging container unit for storing and unloading springs. A box body of the packaging container unit for storing and unloading springs is a prismatic shape, a bottom surface of the box body comprises a first opening, a cross-section of the box body is larger than a cross-section of each of the springs, side surfaces of a top end of the box body extends to form two extendable surfaces opposite to each other, the two extendable surfaces are connected together to form a first top surface so as to define a second opening for unloading the springs on adjacent surfaces of the two extendable surfaces, and the bottom surface of the box body is disposed with at least one of an end cover or one or more one-way toggle pieces.

Further, an upper side of the side surfaces of the top end of the box body adjacent to the two extendable surfaces extends to form two second top surfaces, and the two second top surfaces are configured to be connected together to close a top surface of the box body.

Further, the first top surface is configured to be divided into two connecting surfaces.

Furthermore, a bottom end of the box body is disposed with the one or more one-way toggle pieces extending toward an inner side of the box body to have merely forward deformation of the one or more one-way toggle pieces instead of reverse deformation. In the aforementioned technical solution, when the springs are pressed into the box body from the bottom surface of the box body, forward deformation of the one or more one-way toggle pieces results. After the springs are separated from the one or more one-way toggle pieces, the one or more one-way toggle pieces reset to initial states, preventing the springs inside the box body from being separated from the box body through the bottom surface of the box body.

Further, the one or more one-way toggle pieces form one or more acute angles with the box body, and when the springs are disposed in the box body, the one or more one-way toggle pieces swing, and one or more angles of the one or more acute angles decrease.

Further, the one or more one-way toggle pieces are integrally molded with the box body.

Further, one or more ends of the one or more one-way toggle pieces adjacent to the bottom surface of the box body extend to form one or more connecting walls, and the one or more connecting walls are connected to an outer wall of a side surface of the bottom end of the box body. In the aforementioned technical solution, a connection method between the one or more connecting walls and the outer wall of the side surface of the bottom end of the box body comprise a buckle connection, a plug-in connection, a threaded connection, a sleeved connection, or an adhesive connection, but the disclosure is not limited thereto.

Further, the one or more one-way toggle pieces comprise a plurality of one-way toggle pieces, connecting walls of the one or more connecting walls on the plurality of one-way toggle pieces are connected together to form an annular structure, and the annular structure is sleeved on the outer wall of the side surface of the bottom end of the box body and is in interference fit with the side surface of the bottom end of the box body. In the aforementioned technical solution, as the annular structure abuts the outer wall of the side surface of the bottom end of the box body, the plurality of one-way toggle pieces can be further prevented from reverse deformation and have high structural reliability. In addition, positions of the plurality of one-way toggle pieces and the annular structure are relatively fixed, and the annular structure has an interference fit with the side surface of the bottom end of the box body, which has the advantages of easy installation and simple and stable structure.

In a fourth aspect, the present disclosure provides a packaging container for storing and reloading the springs, the packaging container for storing and reloading the springs comprises at least two of the packaging container units for storing and loading the springs. The packaging container for storing and loading the springs has the advantage of controlled loading and unloading of the springs. In addition, when there are a large number of the springs, the springs are placed in multiple of the packaging container units for storing and unloading the springs that are respectively movable, so that a weight of each of the multiple of the packaging container units for storing and unloading the springs can be effectively reduced, which is more convenient for storage and transportation. Furthermore, the multiple of the packaging container units for storing and unloading the springs can be assembled or disassembled.

In a fifth aspect, the present disclosure provides a packaging method for storing and unloading springs, the packaging method comprises a packaging container unit for storing and unloading the springs, a box body of the packaging container unit for storing and unloading the springs is an elongated shape, a bottom surface of the box body comprises a first opening, one or more one-way toggle pieces extending toward an inner side of the box body are disposed on the bottom surface of the box body, a side surface of a top end of the box body comprises a second opening for unloading the springs, and the packaging method comprises: when the springs are put into the box body, inserting the springs from the bottom surface of the box body, and loading the springs in sequence in a single line; and when the springs are taken out of the box body, opening the second opening for unloading the springs, unloading an uppermost spring of the springs, pushing a next uppermost spring of the springs in the box body to the second opening for unloading the springs under an elastic force of the springs, and then unloading the next uppermost spring through the second opening for unloading the springs.

In a sixth aspect, the present disclosure provides A packaging method for storing and unloading springs, the packaging method comprising a packaging container unit for storing and unloading the springs, a box body of the packaging container unit for storing and unloading the springs is a prismatic shape, a bottom surface of the box body comprises a first opening, one or more one-way toggle pieces extending toward an inner side of the box body are disposed on the bottom surface of the box body, side surfaces of a top end of the box body extends to form two extendable surfaces opposite to each other, the two extendable surfaces are connected together to form a first top surface so as to define a second opening for unloading the springs on adjacent surfaces of the two extendable surfaces, and the packaging method comprises: when the springs are put into the box body, folding the two extendable surfaces toward the inner side of the box body, closing a top surface of the box body, inserting the springs from the bottom surface of the box body, and loading the springs in sequence in a single line; and when the springs are taken out of the box body, unfolding the two extendable surfaces to form the first top surface, forming the second opening for unloading the springs on the adjacent surfaces of the two extendable surfaces, and unloading the springs from the second opening for unloading the springs.

Compared with the existing techniques, the technical solution has the following advantages.

1. The opening for unloading the spring of the packaging container unit for storing and unloading the springs is disposed on the side surface of the top end of the box body or is defined by the adjacent surfaces of the two extendable surfaces. The path for separating the springs from the packaging container unit for storing and unloading the springs through the opening for unloading the springs is perpendicular to the long axis of the packaging container unit for storing and unloading the springs. Therefore, the springs do not easily spring out by the elastic force to achieve controlled unloading of the springs.
2. In some available implementations, the bottom surface of the box body is disposed with the one or more one-way toggle pieces. The one or more one-way toggle pieces can prevent the springs from springing out of the bottom surface of the box body to achieve controlled loading of the springs when the springs are loaded.

Figure 1:
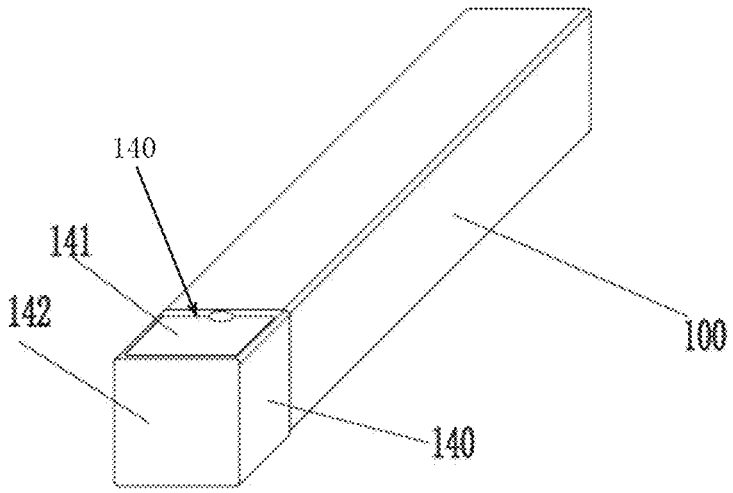
FIG. 1 shows a perspective structural view of a packaging container unit for storing and unloading springs of Embodiment 1.

Reference numbers in the accompanying drawings are as follows: a box body 100, a bottom surface 110 of the box body, a side surface 120 of a bottom end of the box body, a buckling groove 121, a top surface 130 of the box body, a side surface 140 of a top end of the box body, an opening 141 for unloading a spring, an outlet cover 142, a one-way toggle piece 200, a connecting wall 210, a position-limiting buckle 211, an extendable surface 300, a first insertion sheet 301, a second top surface 310, a connecting surface 311, a first top surface 400, a second insertion sheet 401, a spring 500, a folding crease 600.

DETAILED DESCRIPTION OF THE EMBODIMENTS

The embodiments of the present disclosure will be clearly described below in combination with the accompanying drawings to enable the aforementioned objectives, features, and advantages of the present disclosure to be more obvious and understandable. Multiple specific details are described in the following description to facilitate the present disclosure to be completely understood. However, the present disclosure can be implemented using multiple other methods different from the description herein, and similar improvements can be obtained by a person of skill in the art without contradicting the contents of the present disclosure. Therefore, the present disclosure is not limited by the specific embodiments disclosed below.

It should be noted that when an element is referred to as being "fixed to" another element, it can be directly fixed to another element or be indirectly fixed to another element via one or more intermediate elements. When the element is referred to as being "connected to" another element, it can be directly connected to another element or be indirectly connected to another element via one or more intermediate elements. The terms used in the description herein, such as "vertical", "horizontal", "left", and "right", are merely used for illustrative purposes.

In the present disclosure, "slightly larger" means that a cross section of a box body 100 can cover a maximum cross section of springs 500, and an area of the cross section of the box body 100 is larger an area of the maximum cross section of the springs 500 by no more than 30%. When the area of the cross section of the box body 100 is larger than the area of the maximum cross section of the springs 500 by more than 30%, the springs 500 may bend or tilt away from a direction of a longitudinal axis of the box body 100 after entering into the box body 100, causing two of the springs 500 to become transversely jammed within the box body 100 and to be prevented from moving from a bottom surface 110 of the box body 100 to a top surface 130 of the box body 100 under an elastic force. Preferably, the area of the cross section of the box body 100 is larger than the area of the maximum cross section of the springs 500 by more than 10%.

In the present disclosure, "up" is used as a directional term to refer to a direction along the longitudinal axis of the box body 100 from the bottom surface 110 of the box body 100 to the top surface 130 of the box body 100, and "down" is used as a directional term to refer to the direction along the longitudinal axis of the box body 100 from the top surface 130 of the box body 100 to the bottom surface 110 of the box body 100.

Embodiment 1

Referring to FIGS. 1-5, a box body 100 of a packaging container unit for storing and unloading springs 500 of Embodiment 1 is an integrally formed plastic part. FIG. 1 is a perspective structural view of the packaging container unit for storing and unloading the springs 500 provided in Embodiment 1. As shown in FIG. 1, the box body 100 of the packaging container unit for storing and unloading the springs 500 is a prismatic shape (a quadrangular prism). A top surface 130 of the box body 100 is closed. A side surface 140 of a top end of the box body 100 comprises an opening 141 for unloading the springs 500, and the opening 141 for unloading the springs 500 is sleeved with an outlet cover 142.

Figure 2:
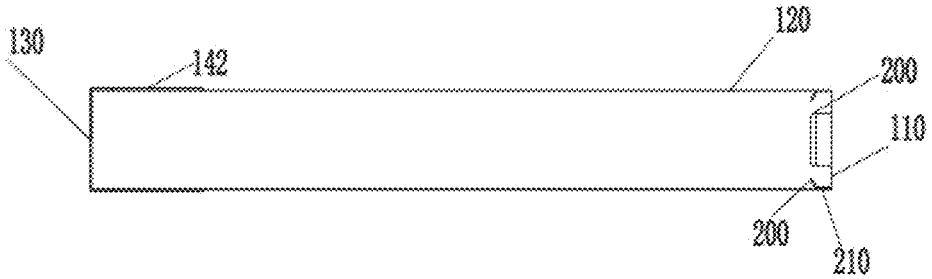
FIG. 2 shows a longitudinal-sectional view of the packaging container unit for storing and unloading the springs of Embodiment 1.
Figure 3:
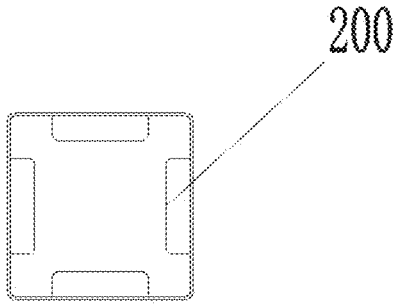
FIG. 3 shows a bottom view of the packaging container unit for storing and unloading the springs of Embodiment 1.

FIG. 2 is a longitudinal-sectional view of the packaging container unit for storing and unloading the springs 500 provided in Embodiment 1, and FIG. 3 is a bottom view of the packaging container unit for storing and unloading the springs 500 provided in Embodiment 1. From FIGS. 1-5, it can be seen that inner walls of side surfaces 120 of a bottom end of the box body 100 are disposed with four one-way toggle pieces 200. Ends of the four one-way toggle pieces 200 adjacent to a bottom surface 110 of the box body 100 extend to form connecting walls 210. The connecting walls 210 are connected to the inner walls of the side surfaces 120 of the bottom end of the box body 100. In other available implementations, the connecting walls 210 can also be connected to outer walls of the side surfaces 120 of the bottom end of the box body 100. It can be seen from FIG. 2 that the four one-way toggle pieces 200 extend toward an inside of the box body 100 to form acute angles with the box body 100, and forward deformation of the four one-way toggle pieces 200 can occur in a direction toward the top surface 130 of the box body 100.

Embodiment 2

A packaging method for storing and unloading springs 500 and a process of storing and unloading the springs 500 provided in Embodiment 2 are described below using the packaging container unit for storing and unloading the springs 500 in Embodiment 1 as a container in conjunction with FIGS. 4-8.

Figure 4:
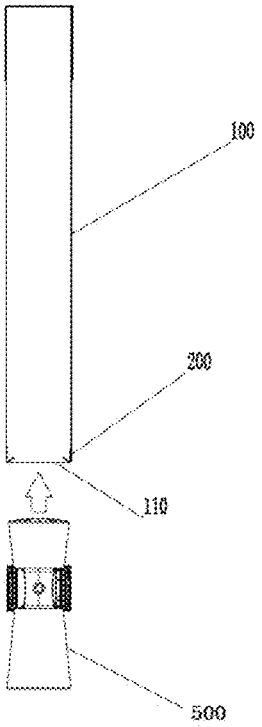
FIGS. 4-6 show diagrammatic views of a process for placing springs into a container in a packaging method for storing and unloading springs of Embodiment 2.
Figure 5:
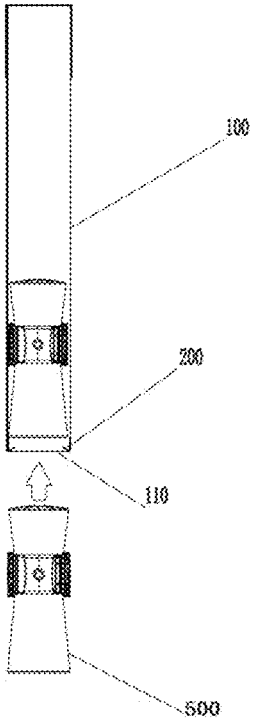
Figure 6:
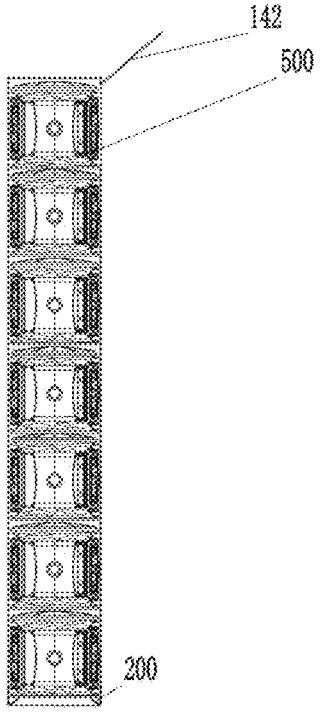

FIGS. 4-6 show diagrammatic views of a process for placing the springs 500 into the container.

When the springs 500 need to be placed into the container, the springs 500 are inserted from the bottom surface 110 of the box body 100. After the springs 500 abut the four one-way toggle pieces 200, the four one-way toggle pieces 200 are squeezed by the springs 500 to generate forward deformation with the acute angles being reduced. Then, the springs 500 move away from the four one-way toggle pieces 200 to slide toward the top surface 130 of the box body 100.

The springs 500 are loaded in sequence in a single line from end to end. As a number of the springs 500 in the box body 100 gradually increases, the springs 500 begin to be compressed, and a lowermost spring 500 of the springs 500 in the box body 100 abuts the four one-way toggle pieces 200. As the four one-way toggle pieces 200 cannot be reversely deformed, the springs 500 cannot move away from the bottom surface 110 of the box body 100.

Figure 7:
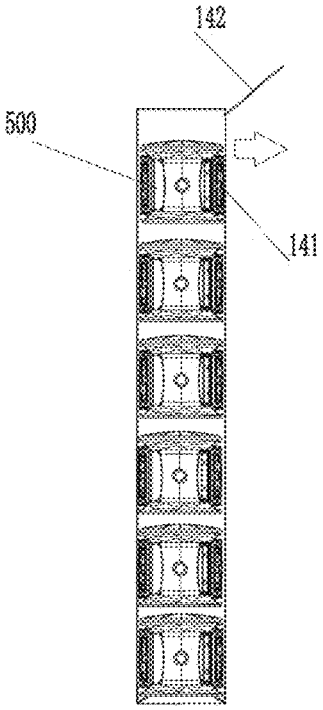
FIGS. 7 and 8 show diagrammatic views of a process of taking the springs out of the container in the packaging method for storing and unloading the springs of Embodiment 2.
Figure 8:
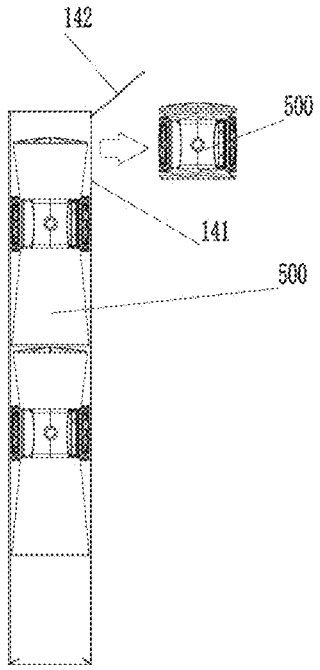

FIGS. 7 and 8 show diagrammatic views of a process for unloading the springs 500 from the container.

When the springs 500 need to be taken out, the outlet cover 142 is opened, and an uppermost spring 500 of the springs 500 in the box body 100 can be taken out from the opening 141 for unloading the springs 500. As the number of the springs 500 in the box body 100 decreases, an amount of compression of the springs 500 decreases gradually, lengths of the springs 500 increase, and a next uppermost spring 500 of the springs 500 is pushed to the opening 141 for unloading the springs 500 due to an elastic force of the springs 500. The aforementioned operation is repeated until all required springs of the springs 500 are taken out.

Embodiment 3

Figure 9:
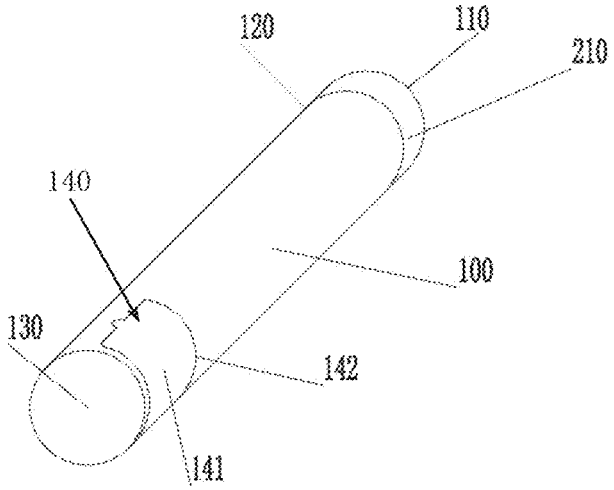
FIG. 9 shows a perspective structural view of a packaging container unit for storing and unloading springs of Embodiment 3.
Figure 10:
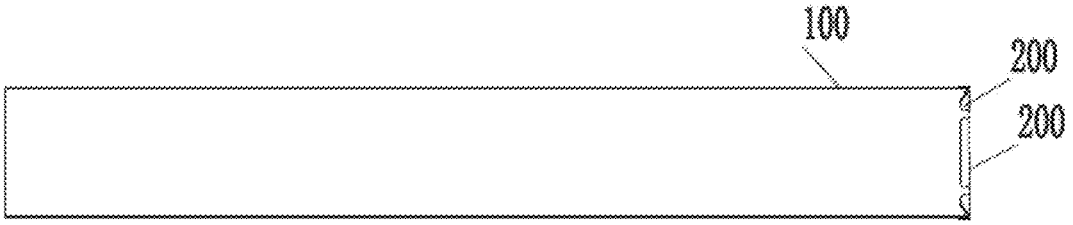
FIG. 10 shows a longitudinal-sectional view of the packaging container unit for storing and unloading the springs of Embodiment 3.

FIG. 9 shows a perspective structural view of a packaging container unit for storing and unloading springs 500. A box body 100 of the packaging container unit for storing and unloading the springs 500 is a cylindrical shape. A top surface 130 of the box body 100 is closed. A side surface 140 of a top end of the box body 100 comprises an opening 141 for unloading the springs 500, and an outlet cover 142 covers the opening 141 for unloading the springs 500. A bottom surface 110 of the box body 100 is disposed with four one-way toggle pieces 200 (not shown in FIG. 9, as shown in FIG. 10). Ends of the four one-way toggle pieces 200 adjacent to the bottom surface 110 of the box body 100 extend to form connecting walls 210, and the connecting wall 210 are connected together to form an annular structure to be sleeved on outer walls of side surfaces 120 of a bottom end of the box body 100.

Figure 11:
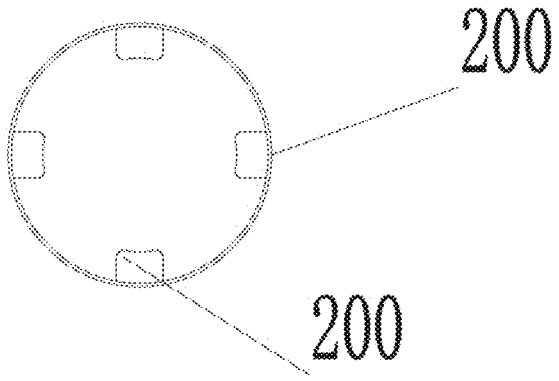
FIG. 11 shows a bottom view of the packaging container unit for storing and unloading the springs of Embodiment 3.

FIG. 10 shows a longitudinal-sectional view of the packaging container unit for storing and unloading the springs 500 provided in Embodiment 3, and FIG. 11 shows a bottom view of the packaging container unit for storing and unloading the springs 500 provided in Embodiment 3. It can be seen from FIGS. 9-11 that the four one-way toggle pieces 200 extend toward an inner side of the box body 100 to form acute angles with the box body 100. In this embodiment, gaps between the four one-way toggle pieces 200 are equal, and pairwise ones of the four one-way toggle pieces 200 do not interfere with each other. With this arrangement, when the four one-way toggle pieces 200 are subjected to pressure, a stress on the four one-way toggle pieces 200 and the annular structure is relatively uniform, which helps to improve durability of the four one-way toggle pieces 200.

Embodiment 4

Figure 12:
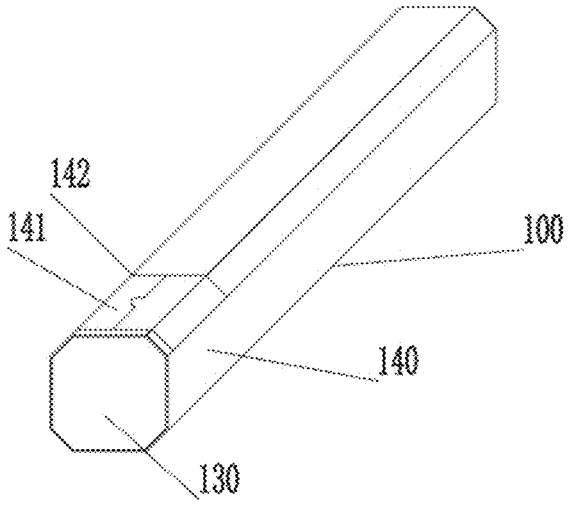
FIG. 12 shows a perspective structural view of the packaging container unit for storing and unloading the springs of Embodiment 4.

FIG. 12 shows a perspective structural view of a packaging container unit for storing and unloading springs 500. A box body 100 of the packaging container unit for storing and unloading the springs 500 is a prismatic shape (an octagonal prism). A top surface 130 of the box body 100 is closed. A side surface 140 of a top end of the box body 100 comprises an opening 141 for unloading the springs 500, and an outlet cover 142 covers the opening 141 for unloading the springs 500. The outlet cover 142 is directly formed on the box body 100 and is integrally molded with the box body 100.

Figure 13:
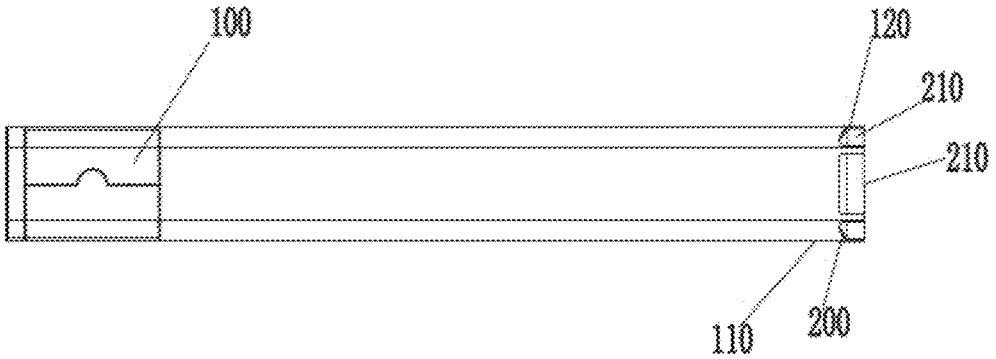
FIG. 13 shows a longitudinal-sectional view of a packaging container unit for storing and unloading springs of Embodiment 4.
Figure 14:
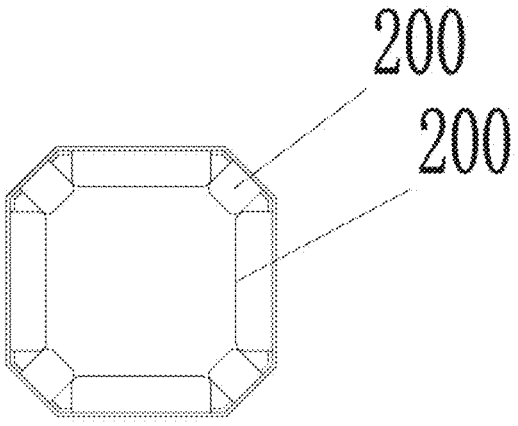
FIG. 14 shows a bottom view of the packaging container unit for storing and unloading the springs of Embodiment 4.

FIG. 13 shows a longitudinal-sectional view of the packaging container unit for storing and unloading the springs 500 provided in Embodiment 4, and FIG. 14 shows a bottom view of the packaging container unit for storing and unloading the springs 500 provided in Embodiment 4. As shown in FIGS. 12-14, it can be seen that side surfaces 120 of a bottom end of the box body 100 are disposed with eight one-way toggle pieces 200. Ends of the eight one-way toggle pieces 200 adjacent to the bottom surface 110 of the box body 100 extend to form connecting walls 210, and the connecting walls 210 are adhered to inner walls of the side surfaces 120 of the bottom end of the box body 100. The eight one-way toggle pieces 200 extend toward an inner side of the box body 100 to form acute angles with the box body 100. In this embodiment, pairwise ones of the eight one-way toggle pieces 200 do not interfere with each other.

Embodiment 5

Figure 15:
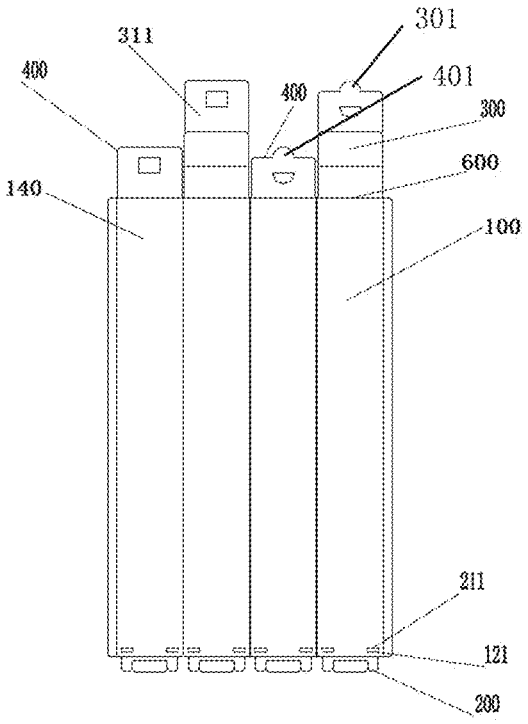
FIG. 15 shows an unfolded diagrammatic view of a packaging container unit for storing and unloading springs of Embodiment 5.
Figure 16:
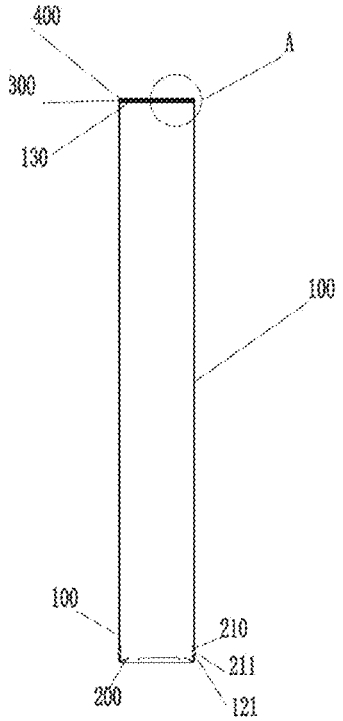
FIG. 16 shows a first longitudinal-sectional view of the packaging container unit for storing and unloading the springs of Embodiment 5 when extendable surfaces are in a closed state.
Figure 17:
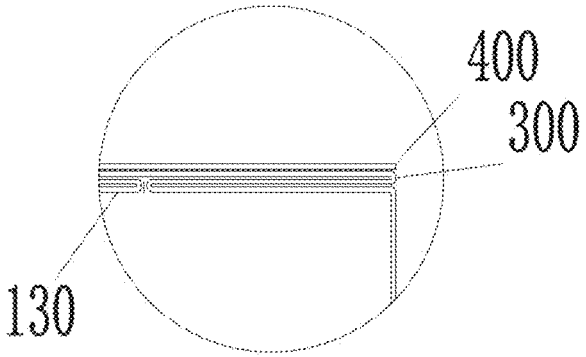
FIG. 17 shows an enlarged view of part A in FIG. 16.
Figure 18:
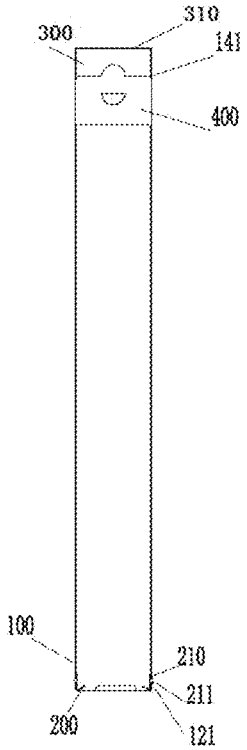
FIG. 18 shows a second longitudinal-sectional view of the packaging container unit for storing and unloading the springs of Embodiment 5 when the extendable surfaces are in an unfolded state.

FIG. 15 shows an unfolded diagrammatic view of a packaging container unit for storing and unloading springs provided in Embodiment 5. As shown in FIGS. 15-18, the packaging container unit for storing and unloading the springs 500 is unfolded to define cardboard. In other available implementations, the packaging container unit for storing and unloading the springs 500 can be a plastic sheet. Two sides of the cardboard respectively comprise two adhesive surfaces. The packaging container unit for storing and unloading the springs 500 can be obtained by adhering the two adhesive surfaces to each other. A box body 100 of the packaging container unit for storing and unloading the springs 500 in Embodiment 5 is a prismatic shape (a quadrangular prism). A bottom surface 110 of the box body 100 comprises an opening (not shown in FIG. 15). Side surfaces 140 of a top end of the box body 100 extends to form two extendable surfaces 300 opposite to each other. Ends of the two extendable surfaces 300 away from the box body 100 comprise two connecting surfaces 311. The two connecting surfaces 311 can be connected to form a second top surface 310 through first insertion sheets 301 so as to define an opening 141 for unloading springs 500 on adjacent surfaces of the two connecting surfaces 311 (the second top surface 310 and the opening 141 for unloading the springs 500 are not shown in FIG. 15, as shown in FIG. 18). An upper side of the side surfaces 140 of the top end of the box body 100 adjacent to the two extendable surfaces 300 extends to form two first top surfaces 400 opposite to each other, and the two first top surfaces 400 are configured to be connected together through second insertion sheets 401.

Side surfaces 120 of a bottom end of the box body 100 are disposed with four one-way toggle pieces 200 (in FIG. 15, the four one-way toggle pieces 200 are in an unfolded state and have not extended toward an inner side of the box body 100 yet). Ends of the four one-way toggle pieces 200 adjacent to the bottom surface 110 of the box body 100 extend to form connecting walls 210 (not shown in the FIG. 15, as shown in FIG. 16). The connecting walls 210 comprise position-limiting buckles 211, and the side surfaces 120 of the bottom end of the box body 100 comprises buckling grooves 121 corresponding to the position-limiting buckles 211. The four one-way toggle pieces 200 are connected to the side surfaces 120 of the bottom end of the box body 100 through a cooperating connection of the position-limiting buckles 211 and the buckling grooves 121. Folding creases 600 are respectively disposed on the two extendable surfaces 300 and between the two extendable surfaces 300 and the side surfaces 140 of the top end of the box body 100, and the two extendable surfaces 300 are configured to be folded toward the inner side of the box body 100 through the folding creases 600.

FIG. 16 shows a longitudinal-sectional view of the packaging container unit for storing and unloading the springs 500 provided in Embodiment 5 when the two extendable surfaces 300 are in a folded state. FIG. 17 shows an enlarged view of part A in FIG. 16. At this time, the four one-way toggle pieces 200 extend toward the inner side of the box body 100 to form acute angles with the box body 100. The two extendable surfaces 300 are folded to be disposed in the box body 100, and the top surface 130 of the box body 100 is closed by the two first top surfaces 400.

FIG. 18 shows a longitudinal-sectional view of the packaging container unit for storing and unloading the springs 500 provided in Embodiment 5 when the two extendable surfaces 300 are in an unfolded state. As shown in FIG. 18, the two extendable surfaces 300 are unfolded to form the second top surface 310 so as to expose the opening 141 for unloading springs. At this time, the two first top surfaces 400 are in a separated state.

Embodiment 6

A packaging method for storing and unloading springs 500 and a process of storing and unloading the springs 500 provided in Embodiment 6 are described below using the packaging container unit for storing and unloading the springs 500 in Embodiment 5 as a container in conjunction with FIGS. 19-24.

Figure 19:
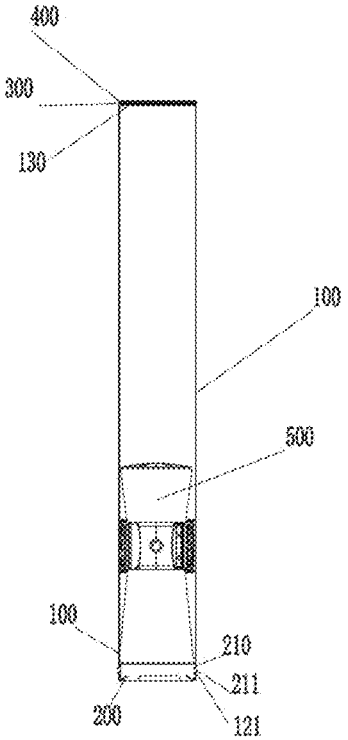
FIGS. 19 and 20 show diagrammatic views of a process for placing springs into a packaging container unit for storing and unloading the springs in a packaging method for storing and unloading the springs of Embodiment 6.
Figure 20:
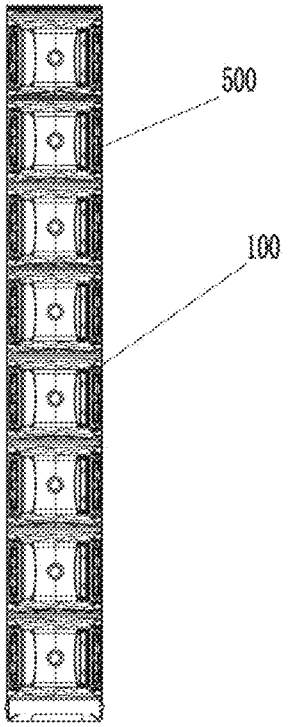

FIGS. 19-20 show diagrammatic views of a process for placing the springs 500 into the container.

When the springs 500 need to be placed into the container, the two extendable surfaces 300 are folded toward the inner side of the box body 100 to close the top surface 130 of the box body 100. At this time, the top surface 130 of the box body 100 is in a closed state, so that the springs 500 cannot be separated from the box body 100 from the top surface 130 of the box body 100 after the springs 500 are disposed into the box body 100.

The springs 500 are inserted from the bottom surface 110 of the box body 100. After the springs 500 abut the four one-way toggle pieces 200, the four one-way toggle pieces 200 are squeezed by the springs 500 to generate forward deformation with the acute angles being reduced. Then, the springs 500 move away from the four one-way toggle pieces 200 to slide toward the top surface 130 of the box body 100.

The springs 500 are loaded in sequence in a single line from end to end. As a number of the springs 500 in the box body 100 gradually increases, the springs 500 begin to be compressed, and a lowermost spring 500 of the springs 500 in the box body 100 abuts the four one-way toggle pieces 200. As the four one-way toggle pieces 200 cannot be reversely deformed, the springs 500 cannot move away from the box body 100 through the bottom surface 110 of the box body 100.

Figure 21:
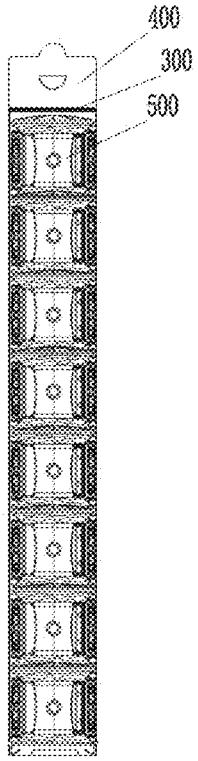
FIGS. 21-23 show diagrammatic views of a process for taking the springs out of the packaging container unit for storing and unloading the springs in the packaging method for storing and unloading the springs of Embodiment 6.
Figure 22:
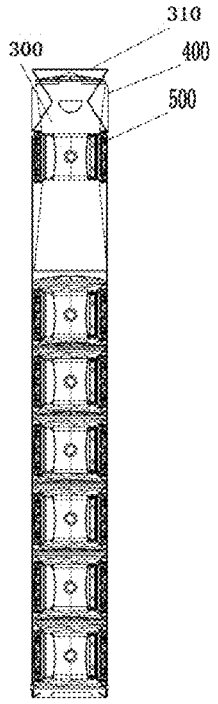
Figure 23:
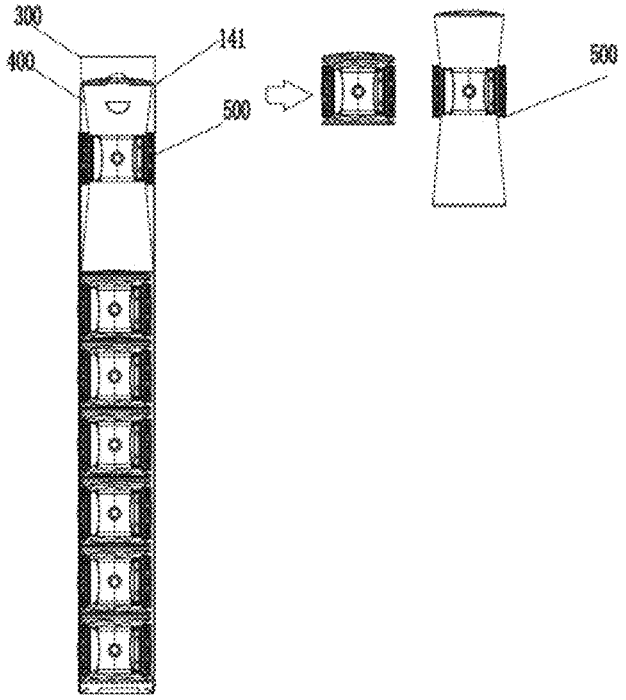

FIGS. 21-23 show diagrammatic views of a process for unloading the springs 500 from the container.

When the springs 500 need to be taken out, the two first top surfaces 400 are separated from each other. After confirming that the two connecting surfaces 311 of the two extendable surfaces 300 are in a connected state, the two extendable surfaces 300 are unfolded. The two connecting surfaces 311 form the second top surface 310 to enable adjacent surfaces of the two extendable surfaces 300 define the opening 141 for unloading the springs 500. At the same time, as the two extendable surfaces 300 are unfolded, a total length of the packaging container unit for storing and unloading the springs 500 increases, and an amount of compression of the springs 500 decreases gradually. An uppermost spring 500 of the springs 500 is pushed to the opening 141 for unloading the springs 500 by an elastic force of the springs 500, allowing the uppermost spring 500 to be taken out from the opening 141 for unloading the springs 500.

Unless otherwise defined, all technical and scientific terms used in the description have the same meaning as commonly understood by a person of skill in the art pertinent to the present disclosure. In the description, the terms used in the specification of the present disclosure are merely for describing specific embodiments instead of limiting the present disclosure. The terms "and" and "or" used in the description comprise any and all combinations of one or more of the correlative listed items.

All of the technical features of the aforementioned embodiments can be freely combined. In order to simplify the description, not all possible combinations of all technical features in the aforementioned embodiments are described, and the combinations of the technical features fall within the scope of the present disclosure provided that there is no contradiction.

The aforementioned embodiments merely illustrate several embodiments of the present disclosure, the description of the aforementioned embodiments is specific and particular and cannot be understood as limitation of the scope of the present disclosure. It should be pointed out that several variations and improvements fall within the protection scope of the present disclosure provided that they are made without departing from the concept of the present disclosure by those of ordinary skill in the art. Therefore, the protection scope of the present disclosure is defined by the appended claims.

What is claimed is:

1. A packaging method for storing and unloading springs, comprising a packaging container unit for storing and unloading the springs, wherein:

a box body of the packaging container unit for storing and unloading the springs is an elongated shape, a bottom surface of the box body comprises a first opening, one or more one-way toggle pieces extending toward an inner side of the box body are disposed on the bottom surface of the box body, a second opening for unloading the springs is integrally formed on a side surface of a top end of the box body, and the packaging method comprises:

inserting the springs from the bottom surface of the box body, and loading the springs in sequence in a single line, thus putting the springs into the box body; and opening the second opening for unloading the springs, unloading an uppermost spring of the springs, pushing a next uppermost spring of the springs in the box body to the second opening for unloading the springs under an elastic force of the springs, and then unloading the next uppermost spring through the second opening for unloading the springs, thus taking the springs out of the box body.

2. A packaging method for storing and unloading springs, comprising a packaging container unit for storing and unloading the springs, wherein:

a packaging container unit is configured to store the springs and the springs are configured to be unloaded from the packaging container unit, a box body of the packaging container unit is prismatic shaped, a bottom surface of the box body comprises a first opening, one or more one-way toggle pieces extending toward an inner side of the box body are disposed on the bottom surface of the box body, side surfaces of a top end of the box body extends to form two extendable surfaces opposite to each other, the two extendable surfaces are connected together to form a first top surface so as to integrally define a second opening for unloading the springs on adjacent surfaces of the two extendable surfaces, an upper side of the side surfaces of the top end of the box body adjacent to the two extendable surfaces extends to form two second top surfaces, and the two second top surfaces are configured to be connected together to close a top surface of the box body, the packaging method comprises:

folding the two extendable surfaces toward the inner side of the box body, closing the two second top surfaces of the box body, inserting the springs from the bottom surface of the box body, and loading the springs in sequence in a single line, thus putting the springs into the box body; and unfolding the two extendable surfaces to form the first top surface, forming the second opening for unloading the springs on the adjacent surfaces of the two extendable surfaces, and unloading the springs from the second opening for unloading the springs, thus taking the springs out of the box body.

* * * * *